United States Patent [19]

Sato et al.

[11] Patent Number: 4,924,568

[45] Date of Patent: May 15, 1990

[54] BURNISHING DEVICE FOR EXTERNAL SURFACES OF WORKPIECES HAVING CIRCULAR SECTIONAL CONTOURS

[75] Inventors: Kazuyoshi Sato; Hideaki Okajima, both of Shizuoka, Japan

[73] Assignee: Kabushiki Kaisha Sugino Machine, Uotsu, Japan

[21] Appl. No.: 183,244

[22] Filed: Apr. 19, 1988

[30] Foreign Application Priority Data

Apr. 21, 1987 [JP] Japan ..... 62-61209[U]

[51] Int. Cl.[5] ..... B24B 39/04; B21C 37/30

[52] U.S. Cl. ..... 29/90.01; 29/90.5; 72/78; 72/121

[58] Field of Search ..... 29/90.01, 90.5; 72/75, 72/77, 78, 100, 120, 121, 126

[56] References Cited

U.S. PATENT DOCUMENTS

| | | | |
|---|---|---|---|
| Re. 16,220 | 12/1925 | Mirfield | 72/121 |
| 455,336 | 7/1891 | Johnston | 72/78 |
| 2,843,918 | 7/1958 | Koppelmann | 29/90.01 |
| 3,504,514 | 4/1970 | Korson | 29/90.01 |
| 3,535,900 | 10/1970 | Isaacs | 72/78 |
| 3,626,560 | 12/1971 | Kalen | 29/90.01 |
| 3,791,000 | 2/1974 | Kunze | 29/90.01 |
| 4,393,675 | 7/1983 | Azarevich et al. | 72/71 |

*Primary Examiner*—William Terrell

*Attorney, Agent, or Firm*—Fleit, Jacobson, Cohn, Price, Holman & Stern

[57] ABSTRACT

A roller burnishing device for sizing and/or finishing the external surface of a workpiece having a circular sectional contour by causing a relative rotation between the workpiece and a plurality of truncated conical rollers arranged within a head having a truncated conical inner surface. In this device, the head is made nonrotatable and instead a hollow cylindrical cage supporting the rollers within the head is driven in rotation to rotate the rollers at a high speed and the rollers are caused to orbit by driving the cage in low speed rotation thereby causing the rollers to make a planetary motion within the head.

9 Claims, 2 Drawing Sheets

BURNISHING DEVICE FOR EXTERNAL SURFACES OF WORKPIECES HAVING CIRCULAR SECTIONAL CONTOURS

BACKGROUND OF THE INVENTION

1. Field of the Invention

The present invention relates to a device for sizing and/or finishing the external surface of a workpiece having a circular sectional contour, such as, a cylinder, and more particularly the invention relates to a burnishing device for continuously rolling the external surface of such workpiece of a relatively long type.

2. Description of the Prior Art

Methods heretofore known for producing a relatively high degree of surface finish on the external surface of a round workpiece, such as, a column or cylinder include polishing, lapping, superfinish cutting and burnishing. Of these methods, the burnishing is used effectively since this method is capable of simultaneously attaining an increased surface hardness, surface finish close to mirror finish and improved dimensional accuracy.

Burnishing tools of various shapes are provided to meet the needs for the treatment of work surfaces of various forms. Presently, the tools of many different shapes are in use for the working of such surfaces as bore inner surfaces, cylinder end faces, cone outer surfaces, cone inner surfaces, column outer surfaces, flat surfaces and spherical surfaces. These conventionally used burnishing devices are generally of the type in which the tool is mechanically pressed against or moved along the surface of a workpiece to apply the tool to the desired work surface. In other words, the tool is driven in both rotary and propelling motions relative to the workpiece so as to perform the burnishing operation over the desired range while changing its working position. The fact of requiring the two driving operations, rotating and propelling movements, gives rise to the disadvantage of complicating the processing operation. In particular, when processing the external surface of a long columnar or cylindrical workpiece to which the invention is directed, the propelling movement is required over the whole length of the long workpiece thus making the device bulky.

Devices heretofore proposed to overcome the foregoing deficiencies include for example a workpiece self-advancing type device disclosed in U.S. Pat. No. 3,626,560. The device stated in this U.S. patent is constructed so that a hollow head externally enclosing a plurality of truncated conical rollers arranged parallel to each other in a cage-like form is driven in rotation and therefore the rotational speed during the rotation of the head must be considerably high in order to rotate the rollers at a given rotational speed. In order that the degrees of the quality and finish of a workpiece may be controlled at the desired values, it is the usual practice to variably control the rotational speed of the tool and therefore in the device of the previously mentioned U.S. patent the high rotational speed must be variably controlled, thus causing the control to tend to become difficult and complicated. Also, in order to drive the head in rotation, the surrounding structure of the head is complicated and it is essential to include the built-in springs in the mechanism for adjusting the finished outer diameter thus causing complication of the construction and the occurrence of faults or troubles.

SUMMARY OF THE INVENTION

It is an object of the present invention to provide a burnishing device including no spring and capable of performing a stable burnishing operation by simply producing only a low-speed rotational drive thus permitting a self-advancing of the workpiece due to a higher rotational speed of rollers.

To accomplish the above object, in accordance with the invention there is thus provided a burnishing device incorporating an improved mechanism which renders a head nonrotatable but causes a plurality of rollers to orbit by means of an externally applied rotating power.

More specifically, the burnishing device according to the invention basically includes a head formed with a truncated conical aperture axially arranged on the center axis thereof so as to axially pass therethrough a workpiece to be processed which has a circular sectional contour; a hollow cylindrical cage having a plurality of elongated slots directed substantially axially and located within the aperture of the head; a plurality of rollers confined within the slots with the inner edges of the rollers substantially parallel to each other and the outer edges of the rollers contacting the inner surface of the aperture; and means for rotating the rollers between the external surface of the workpiece and the inner surface of the aperture, and in particular the device features the provision of a supporting mechanism for supporting the head nonrotatably; and a power rotating mechanism for driving the cage to rotate about its axis in such a manner that an orbital movement of the rollers about the tool axis is permitted to cause each of the rollers to rotate about it axis.

Preferably, the supporting mechanism includes adjusting means for displacing the head axially relative to the cage confining the rollers within its slots, thereby allowing the finished external surface of a workpiece by the rollers to attain a given diameter.

In accordance with another preferred form of the invention, the power rotating mechanism includes a hollow shank member extending coaxially from the cage in a direction opposite to the head so as to permit a finished workpiece to pass axially through the hollow shank member and also the hollow shaft member includes rotation transmitting means for receiving the rotating power transmitted thereto.

With the construction described above, the supporting mechanism for supporting the head is for example fixedly secured to the body or a base of the burnishing device and the head is nonrotatably fixed in place. On the other hand, the cage is driven in rotation through the hollow shank member by suitable rotation transmitting means, such as, a pulley associated with an electric motor. When the hollow shank member is rotated, by cage secured to the forward end of the hollow shank member is rotated together with the hollow shank member. When the cage is rotated, the rollers confined rotatably within the slots act so that they are brought into close contact with the inner surface of the tool head by their outer edges and into close contact with the external surface of a workpiece by their inner edges and the rollers orbit about the workpiece while rotating about their axes. In other words, while being held between the tool head and the workpiece, the rollers roll along with the orbitary movement of the cage thereby rolling the external surface of the workpiece. Since the rollers are generally supported within the slots of the cage so as to be deflected with respect to the axis of the tool head by a given feed angle, when the rollers roll and circulate around the external surface of the workpiece, a propulsive force in a given axial direction is impaired to the workpiece so that the workpiece is substantially moved in the direction of the axis while a rolling operation is being performed on the external surface of the workpiece. As a result, no matter how long the workpiece is, the rolling operation is effectively performed over its whole length. It is to be noted that the feed angle is generally defined so that it is referred to as positive when tending to advance the workpiece and referred to as negative when tending to retract the workpiece. As the feed angle is increased in the positive direction, the speed of axial movement of the workpiece is increased and also the amount of working scars in the surface is increased. In accordance with the invention, the feed angle is not limited to positive values and the invention covers cases where the feed angle may be zero or negative. The invention does not exclude cases where the axial feed of a workpiece is effected through any additional driving by separate system means.

In addition, by preliminarily imparting a mirror finish or applying a lubricating resin coating to the portions through which the workpiece passes after the completion of its treatment, e.g., the inner surface of the cage and the inner surface of the hollow shank member thereby smoothing such surfaces, it is possible to prevent the occurrence of any flaws in the finished surface of the workpiece due to rubbing between these surfaces and the workpiece.

The above and other objects as well as advantageous features of the invention will become more clear from the following description taken in conjunction with the drawings.

DESCRIPTION OF THE PREFERRED EMBODIMENTS

Figure 1:
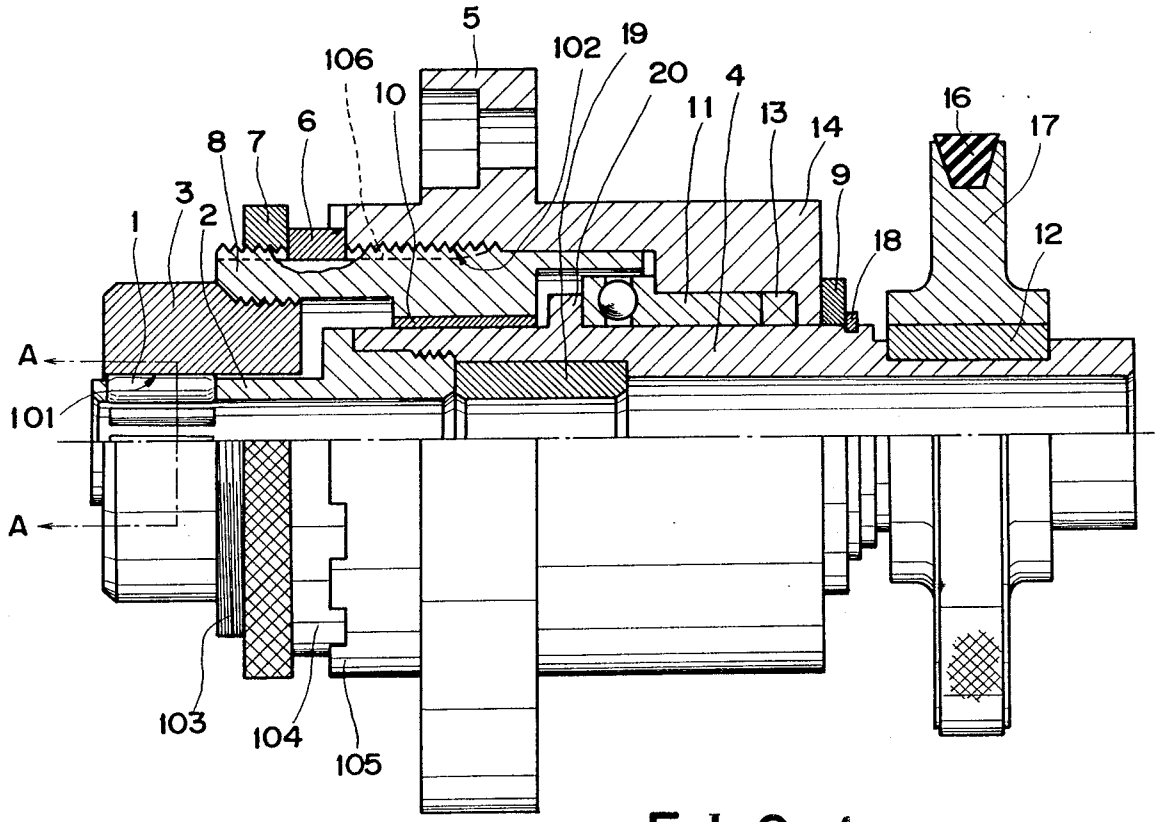
FIG. 1 is a half-broken longitudinal sectional side view of a preferred embodiment of the invention.
Figure 2:
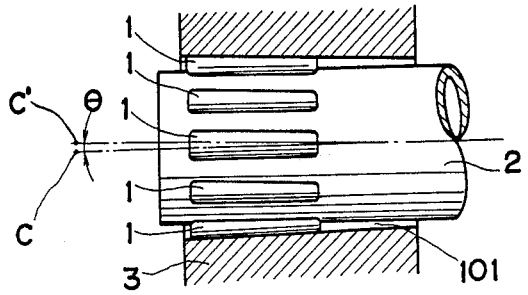
FIG. 2 is an enlarged view showing a selected principal part of the invention.
Figure 4:
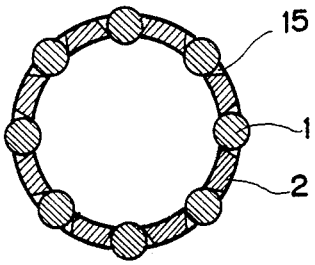
FIG. 4 is a sectional view taken along the line A—A of FIG. 1.

Referring to FIG. 1 illustrating a longitudinal sectional side view showing a preferred embodiment of the present invention, numeral 1 designates truncated conical rollers, 2 a hollow cylindrical cage, 3 a tool head, 4 a hollow shank member, 5 a mounting flange, 6 and 7 an adjusting ring and a lock nut therefor, 8 an intermediate cylindrical member, 9, 10 and 11 bearings, 12 a key, and 13 a sealing member. The plurality of rollers 1 are respectively fitted loosely in a plurality of slots 15 cut in the cage 2 as shown in FIG. 4 and the rollers 1 are arranged to closely contact with the inner surface of a truncated conical aperture 101 formed through the tool head 3 as shown in FIG. 2. Each roller 1 is tapered to decrease gradually in diameter from its forward and pointing to the outside of the aperture 101 toward the inner part of the aperture 101 and its forward and tail ends are bevelled so as to smoothly bite or release a workpiece. The arrangement of the rollers 1 within the aperture 101 will be described later.

On the opposite side to the head 3, the cage 2 is fixedly threaded into the forward end of the hollow shank member 4 through which the workpiece passes. Arranged just behind the cage 2 inside the hollow shank member 4 is a guide member 19 for the workpiece (not shown) which passes axially therethrough and its inner surface is preferably coated with a resin having lubricating properties, such as, PTFE or treated to produce a mirror finish.

On the other hand, the head 3 is fixedly threaded into the forward end of the intermediate cylindrical member 8 which in turn is relatively moveably supported on the outer periphery of the hollow shank member 4 through the slide bearing 10. The intermediate cylindrical member 8 is formed with threads 103 on the outer periphery and an axial groove 106 is formed in the outer surface so as to part the threads 103.

A sleeve member 14 includes the flange 5 so that it is mounted by the flange 5 to the device base which is not shown. The sleeve member 14 is also supported by the bearings 9 and 11 so as to be rotatable relative to the hollow shank member 4 but it is mounted by a stop ring 18 and a small flange 20 of the hollow shank member 4 so as to prevent its relative axial movement.

Figure 3:
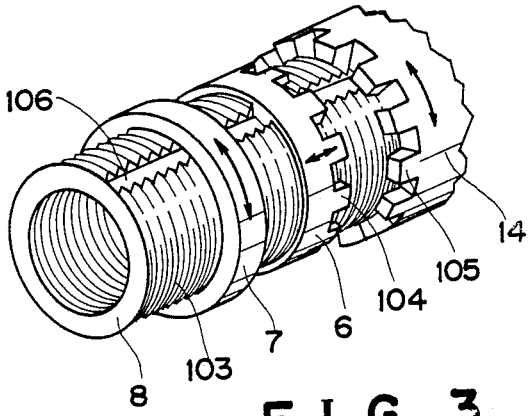
FIG. 3 is a perspective view showing another selected principal part of the invention.

The intermediate cylindrical member 8 is mounted so as to be moved into and out of the sleeve member 14 by threads 102 formed on the sleeve member 14 and the threads 103 formed on the intermediate cylindrical member 8. The adjustment of the movement of the intermediate cylindrical member 8 into and out of the sleeve member 14 is effected so that as shown in FIG. 3, the lock nut 7 engaging with the threads 103 of the intermediate cylindrical member 8 is loosened and the adjusting ring 6, which is in engagement with the groove 106 but out of engagement with the threads 103, is manually shifted toward the tool head 3 so as to disengage notches 104 of the adjusting ring 6 with notches 105 of the sleeve member 14, thereby allowing to manually turn the adjusting ring 6 to threadedly move the intermediate cylindrical member 8 into and out of the sleeve member 14. In this way, the intermediate cylindrical member 8 or the tool head 3 made integral with the former is moved into or out of the sleeve member 14. In other words, while the sleeve member 14 and the hollow shank member 4 are relatively rotatable by means of the bearings 9 and 11, their axial positions are stationarily locked by the stop ring 18 and the small flange 20 so that by adjusting the axial position of the tool head 3 relative to the sleeve member 14, the axial position of the cage 2 relative to the tool head 3 is adjusted and consequently the relative axial positions of the rollers 1 and the aperture 101 of the tool head 3 are adjusted. The aperture 101 of the tool head 3 is formed into a truncated conical shape which gradually decreases in width from the wide forward end toward the inner side as in the case of the conventional device and also the rollers 1 are formed into a truncated conical shape having an angle of slope which is about one half that of the inner surface of the aperture 101 such that the inner edges of the rollers 1 extend in parallel to the axis of the aperture 101 when the rollers 1 are in close contact with the aperture 101 of the tool head 3. Thus, when the contact positions of the rollers 1 and the apertures 101 of the tool head 3 are moved axially, the rollers 1 are moved toward or away radially from the cage 2 in dependence on the slope of the aperture 101 and thus the distance between the axes of the rollers 1 is increased or decreased, thereby adjusting the allowable dimension of the diameter imparted to the external surface of the finished workpiece by the rollers 1. After the dimension has been set, the adjusting ring 6 is again shifted toward the sleeve member 14 to bring the notches 104 and 105 into engagement and then the lock nut 7 is tightened, thereby locking the tool diameter in the set condition. For instance, where the notches 104 and 105 respectively include 12 notches arranged at equal intervals and the amount of diametrical dimension adjustment per pitch of the threads 102 and 103 is 0.03 mm, the minimum unit amount of adjustment due to the shifting of one notch is 0.0025 mm.

Mounted on the tail end side of the hollow shank member 4 is a pulley 17 fixed in place by the key 12 and driving power for rotation is transmitted to the pulley 17 by a belt 16. Of course, any other rotation transmitting mechanism comprising suitable gears may be used in place of the belt and the pulley.

Then, when the pulley 17 is driven in rotation through the belt 16 by a drive such as an electric motor (not shown), the hollow shank member 4 is driven in rotation so that simultaneously with the rotation of the hollow shank member 14, the cage 2 is rotated and the rollers 1 orbit while rotating on their axes, causing the rollers 1 to roll on the inner periphery of the aperture 101 of the tool head 3. At this time, if the workpiece is axially fed and supplied into the interior enclosed by the rollers 1 to engage therewith, the external surface of the workpiece is rolled by the rollers 1. As shown in FIG. 2, the rollers 1 are arranged so that each of the rollers 1 has its axis C' inclined by a given feed angle $\theta$ from the axis C of the tool head 3 or the cage 2 and the workpiece engaging with the inner edges of the rollers 1 is subjected to a propelling force while rotating on its axis, thus moving the workpiece axially while automatically rotating it so as to be processed in a given direction.

Then, in order to process the external surface of a workpiece, the rollers must be caused to roll at a given relative rotational speed on the surface of the workpiece. While the known methods for this purpose include the method of driving a workpiece in rotation, the method heretofore used generally is to drive the tool head 3 in rotation. Then, with either of the method which drives the tool head 3 in rotation and the method which drives the workpiece in rotation, in order to rotate the rollers 1 at a given rotational speed, the tool head 3 or the workpiece must be driven in rotation at a high speed and therefore the control of the rotational speed depending on the types of workpieces is difficult due to the control being effected in the high speed range. In accordance with the system of the invention which drives the cage 2 in rotation, however, the tool head 3 and the sleeve member 14 are locked so as to be relatively nonrotatable with the result that while the rollers 1 themselves rotate on their axes at a high speed within the slots 15 of the cage 2 due to the principle of orbital rotation, the orbitting cage 2 itself can be rotated at a low speed relative to the tool head 3 or the sleeve member 14 thus the control of the driving-side rotation speed can be effected easily. In addition, the fact that the head 3 is a nonrotating member has the effect reducing the occurrence of hazards in operation.

What is claimed is:

1. A burnishing device for an external surface of a workpiece of a circular sectional contour, comprising:

a head formed with a truncated conical aperture arranged axially along a center of said head to pass therethrough a workpiece to be processed;

a hollow cylindrical cage having a plurality of slots arranged substantially axially and located within the aperture of said head;

a plurality of truncated conical rollers confined within said slots with inner edges thereof being parallel to each other and outer edges thereof being in contact with an inner surface of said aperture, with the rollers being rotatable on their own axes respectively in said slots;

a supporting mechanism for nonrotatably supporting said head about said cage; and a power rotating mechanism for driving said cage in rotation about said workpiece and about the axial center of said cage such that said rollers make an orbital motion about a tool central axis to cause said rollers to rotate between the inner surface of said aperture and the external surface of said workpiece about the axes thereof, said power rotating mechanism including a hollow shank member fixedly attached to said cage by which said cage is interconnected with said power rotating mechanism, whereby rotation of said hollow shank member causes said cage to rotate about said workpiece.

2. A burnishing device according to claim 1, wherein said supporting mechanism includes adjusting means for axially displacing said head relative to said cage with said rollers confined in said slots so as to produce a given diameter to the external surface of said workpiece finished by said rollers.

3. A burnishing device for an external surface of a workpiece of a circular sectional contour, comprising:

a head formed with a truncated conical aperture arranged axially along a center of said head to pass therethrough a workpiece to be processed;

a hollow cylindrical cage having a plurality of slots arranged substantially axially and located within the aperture of said head;

a plurality of truncated conical rollers confined within said slots with the inner edges thereof being parallel to each other and the outer edges thereof being in contact with an inner surface of said aperture, with the rollers being rotatable on their own axes respectively in said slots;

a supporting mechanism for nonrotatably supporting said head;

a power rotating mechanism for driving said cage in rotation about the axial center thereof such that said rollers make an orbital motion about a tool central axis to cause said rollers to rotate about the axes thereof;

said supporting mechanism includes adjusting means for axially displacing said head relative to said cage with said rollers confined in said slots so as to produce a given diameter to the external surface of said workpiece finished by said rollers; and said power rotating mechanism includes a hollow shank member coaxially extended from said cage opposite said head, and wherein said hollow shank member is adapted to pass a finished workpiece therethrough and includes rotation transmitting means for receiving a rotating power transmitted thereto.

4. A burnishing device according to claim 3, wherein said cage is fixedly threaded into the forward end of said hollow shank member.

5. A burnishing device according to claim 3, wherein said head is fixedly threaded into the forward end of the intermediate cylindrical member which in turn is relatively movably supported on the outer periphery of said hollow shank member through a slide bearing.

6. A burnishing device according to claim 3, wherein said sleeve member is also supported by bearings so as to be rotatable relative to said hollow shank member and mounted by a stop ring and a small flange to prevent relative axial movement of said sleeve member.

7. A burnishing device according to claim 3, wherein said intermediate cylindrical member is mounted to be movable into and out of said sleeve member by threads formed on said sleeve member and threads formed on the intermediated cylindrical member.

8. A burnishing device according to claim 7, further comprising a lock nut engaging with the threads of said intermediate cylindrical member, wherein the adjustment of the movement of said intermediate cylindrical member into and out of said sleeve member is effected so that said lock nut engaging with the threads of the intermediate cylindrical member are loosened and an adjusting ring in engagement with the groove is manually shifted toward said head so as to disengage notches in said adjusting ring, with notches of said sleeve member, thereby allowing manually turning of the adjusting ring to threadedly move the intermediate cylindrical member into and out of said sleeve member.

9. A burnishing device for external surfaces of workpieces having circular sectional contours comprising:

a head including an aperture of a truncated conical shape axially arranged along a center axis of said head to pass therethrough a workpiece to be processed;

a hollow cylindrical cage having a plurality of slots arranged substantially axially and located within the aperture of said head;

a plurality of truncated conical rollers confined within said slots with inner edges thereof being substantially parallel to each other and outer edges thereof being in contact with an inner surface of said aperture, with the rollers being rotatable on their own axes respectively in said slots;

a power rotating mechanism for driving said cage in rotation about said workpiece and about the axial center of said cage such that said rollers make an orbital motion about a tool center axis to cause said rollers to rotate about the axes thereof, said power rotating mechanism including a hollow shank member coaxially extending from said cage in a direction opposite to said head and being adapted to pass a finished workpiece therethrough, said hollow shank member being fixedly attached to said cage by which said cage is interconnected with said power rotating mechanism whereby rotation of said hollow shank member causes said cage to rotate about said workpiece, and said power rotating mechanism including rotation transmitting means for receiving a rotating power transmitted from external driving means for driving said hollow shank member and said cage in rotation about said workpiece;

an intermediate cylindrical member formed with an external thread, arranged to slidably enclose an outer surface of said hollow shank member so as to be supported thereon and holding said head at the forward end thereof;

a fixed sleeve member supported on the outer surface of said hollow shank member such that said shank and sleeve members are relatively rotatable but restrained from a relative axial movement, said sleeve member having on said head side thereof a threaded opening into which said intermediate cylindrical member is threaded; and a manual adjusting ring for rotating said intermediate cylindrical member relative to said sleeve member to produce through the pitch of the threads thereof and axial displacement of said head.

* * * * *